US008457972B2

(12) United States Patent
Topchy et al.

(10) Patent No.: US 8,457,972 B2
(45) **Date of Patent: *Jun. 4, 2013**

(54) METHODS AND APPARATUS FOR CHARACTERIZING MEDIA

(75) Inventors: Alexander Topchy, New Port Richey, FL (US); Venugopal Srinivasan, Palm Harbor, FL (US); Arun Ramaswamy, Tampa, FL (US)

(73) Assignee: The Nielsen Company (US), LLC, Schaumburg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/619,023

(22) Filed: Sep. 14, 2012

(65) Prior Publication Data

US 2013/0013324 A1 Jan. 10, 2013

Related U.S. Application Data

(63) Continuation of application No. 13/250,663, filed on Sep. 30, 2011, which is a continuation of application No. 12/034,489, filed on Feb. 20, 2008, now Pat. No. 8,060,372.

(60) Provisional application No. 60/894,090, filed on Mar. 9, 2007, provisional application No. 60/890,680, filed on Feb. 20, 2007.

(51) Int. Cl.
*G10L 21/00* (2006.01)
*H04H 60/32* (2008.01)

(52) U.S. Cl.
USPC ..... 704/273; 725/18; 725/19

(58) Field of Classification Search
USPC ..... 704/273; 725/18, 19; 713/179
See application file for complete search history.

(56) References Cited

U.S. PATENT DOCUMENTS 3,845,391 A 10/1974 Crosby
3,919,479 A 11/1975 Moon et al.

(Continued)

FOREIGN PATENT DOCUMENTS

AU 678163 11/1993
AU 718227 11/1997

(Continued)

OTHER PUBLICATIONS

Chinese Patent Office, "First Office Action", issued in connection with Chinese Patent Application No. 2008800128440, Sep. 2, 2010, (4 pages).

(Continued)

*Primary Examiner* — Jialong He
(74) *Attorney, Agent, or Firm* — Hanley, Flight & Zimmerman, LLC

(57) ABSTRACT

Methods and apparatus for characterizing media are described. A disclosed example apparatus includes a transformer, a decision metric processor, a signature determiner, and a processor to implement the transformer, the decision metric processor, and/or the signature determiner. The example transformer is to convert at least a portion of a block of audio into a frequency domain representation including a plurality of frequency components. The example decision metric processor is to: define a band of the frequency components; determine a difference in energy between a first convolution of a first complex vector with a first group of frequency bins in the band and a second convolution of a second complex vector with a second group of frequency bins in the band; and determine a decision metric for the band based on the difference. The example signature determiner is to determine a signature based on a value of the decision metric.

20 Claims, 12 Drawing Sheets

U.S. PATENT DOCUMENTS

| | | | |
|---|---|---|---|
| 4,025,851 | A | 5/1977 | Haselwood et al. |
| 4,053,710 | A | 10/1977 | Advani et al. |
| 4,230,990 | A | 10/1980 | Lert, Jr. et al. |
| 4,282,403 | A | 8/1981 | Sakoe |
| 4,432,096 | A | 2/1984 | Bunge |
| 4,450,531 | A | 5/1984 | Kenyon et al. |
| 4,520,830 | A | 6/1985 | Flanagan, III |
| 4,533,926 | A | 8/1985 | Foldvari et al. |
| 4,547,804 | A | 10/1985 | Greenberg |
| 4,624,009 | A | 11/1986 | Glenn et al. |
| 4,639,779 | A | 1/1987 | Greenberg |
| 4,677,466 | A | 6/1987 | Lert, Jr. et al. |
| 4,697,209 | A | 9/1987 | Kiewit et al. |
| 4,703,476 | A | 10/1987 | Howard |
| 4,739,398 | A | 4/1988 | Thomas et al. |
| 4,783,660 | A | 11/1988 | Pierce |
| 4,805,020 | A | 2/1989 | Greenberg |
| 4,834,724 | A | 5/1989 | Geiss et al. |
| 4,843,562 | A | 6/1989 | Kenyon et al. |
| 4,931,871 | A | 6/1990 | Kramer |
| 4,945,412 | A | 7/1990 | Kramer |
| 4,947,436 | A | 8/1990 | Greaves et al. |
| 4,967,273 | A | 10/1990 | Greenberg |
| 5,023,929 | A | 6/1991 | Call |
| 5,113,437 | A | 5/1992 | Best et al. |
| 5,121,428 | A | 6/1992 | Uchiyama et al. |
| 5,210,820 | A | 5/1993 | Kenyon |
| 5,319,735 | A | 6/1994 | Preuss et al. |
| 5,436,653 | A | 7/1995 | Ellis et al. |
| 5,437,050 | A | 7/1995 | Lamb et al. |
| 5,450,490 | A | 9/1995 | Jensen et al. |
| 5,504,518 | A | 4/1996 | Ellis et al. |
| 5,563,942 | A | 10/1996 | Tulai |
| 5,572,246 | A | 11/1996 | Ellis et al. |
| 5,579,124 | A | 11/1996 | Aijala et al. |
| 5,581,800 | A | 12/1996 | Fardeau et al. |
| 5,612,729 | A | 3/1997 | Ellis et al. |
| 5,621,454 | A | 4/1997 | Ellis et al. |
| 5,629,739 | A | 5/1997 | Dougherty |
| 5,650,943 | A | 7/1997 | Powell et al. |
| 5,687,191 | A | 11/1997 | Lee et al. |
| 5,764,763 | A | 6/1998 | Jensen et al. |
| 5,792,053 | A | 8/1998 | Skladnev et al. |
| 5,822,360 | A | 10/1998 | Lee et al. |
| 5,941,822 | A | 8/1999 | Skladnev et al. |
| 6,002,443 | A | 12/1999 | Iggulden |
| 6,026,323 | A | 2/2000 | Skladnev et al. |
| 6,061,793 | A | 5/2000 | Tewfik et al. |
| 6,151,578 | A | 11/2000 | Bourcet et al. |
| 6,167,400 | A | 12/2000 | Brandin |
| 6,170,060 | B1 | 1/2001 | Mott et al. |
| 6,205,249 | B1 | 3/2001 | Moskowitz |
| 6,272,176 | B1 | 8/2001 | Srinivasan |
| 6,286,005 | B1 | 9/2001 | Cannon |
| 6,317,703 | B1 | 11/2001 | Linsker |
| 6,421,445 | B1 | 7/2002 | Jensen et al. |
| 6,442,283 | B1 | 8/2002 | Tewfik et al. |
| 6,469,749 | B1 | 10/2002 | Dimitrova et al. |
| 6,604,072 | B2 | 8/2003 | Pitman et al. |
| 6,711,540 | B1 | 3/2004 | Bartkowiak |
| 6,751,337 | B2 | 6/2004 | Tewfik et al. |
| 6,871,180 | B1 | 3/2005 | Neuhauser et al. |
| 6,968,564 | B1 | 11/2005 | Srinivasan |
| 6,996,237 | B2 | 2/2006 | Jensen et al. |
| 7,006,555 | B1 | 2/2006 | Srinivasan |
| 7,013,468 | B2 | 3/2006 | Abercrombie et al. |
| 7,058,223 | B2 | 6/2006 | Cox |
| 7,171,016 | B1 | 1/2007 | Rhoads |
| 7,194,752 | B1 | 3/2007 | Kenyon et al. |
| 7,289,643 | B2 | 10/2007 | Brunk et al. |
| 7,302,574 | B2 | 11/2007 | Conwell et al. |
| 7,316,025 | B1 | 1/2008 | Aijala et al. |
| 7,328,153 | B2 | 2/2008 | Wells et al. |
| 7,343,492 | B2 | 3/2008 | Moskowitz et al. |
| 7,698,008 | B2 | 4/2010 | Steinberg |
| 7,712,114 | B2 | 5/2010 | Ramaswamy |
| 7,783,889 | B2 | 8/2010 | Srinivasan |
| 7,921,296 | B2 | 4/2011 | Haitsma et al. |
| 2001/0051996 | A1 | 12/2001 | Cooper et al. |
| 2002/0082731 | A1 | 6/2002 | Pitman et al. |
| 2002/0082837 | A1 | 6/2002 | Pitman et al. |
| 2002/0126872 | A1 | 9/2002 | Brunk et al. |
| 2003/0005430 | A1 | 1/2003 | Kolessar |
| 2003/0054757 | A1 | 3/2003 | Kolessar et al. |
| 2003/0131350 | A1 | 7/2003 | Peiffer et al. |
| 2003/0179909 | A1 | 9/2003 | Wong et al. |
| 2004/0122679 | A1 | 6/2004 | Neuhauser et al. |
| 2004/0170381 | A1 | 9/2004 | Srinivasan |
| 2004/0181799 | A1 | 9/2004 | Lu et al. |
| 2005/0025334 | A1 | 2/2005 | Tewfik et al. |
| 2005/0035857 | A1 | 2/2005 | Zhang et al. |
| 2005/0043830 | A1 | 2/2005 | Lee et al. |
| 2005/0200476 | A1 | 9/2005 | Forr et al. |
| 2005/0203798 | A1 | 9/2005 | Jensen et al. |
| 2005/0216509 | A1 | 9/2005 | Kolessar et al. |
| 2005/0232411 | A1 | 10/2005 | Srinivasan et al. |
| 2005/0243784 | A1 | 11/2005 | Fitzgerald et al. |
| 2005/0268798 | A1 | 12/2005 | Neuhauser et al. |
| 2005/0272015 | A1 | 12/2005 | Jensen et al. |
| 2005/0272017 | A1 | 12/2005 | Neuhauser et al. |
| 2006/0020958 | A1 | 1/2006 | Allamanche et al. |
| 2006/0028953 | A1 | 2/2006 | Jensen et al. |
| 2006/0075237 | A1 | 4/2006 | Seo et al. |
| 2006/0120536 | A1 | 6/2006 | Kemp |
| 2006/0195886 | A1 | 8/2006 | Ashley |
| 2006/0239503 | A1 | 10/2006 | Petrovic et al. |
| 2007/0005118 | A1 | 1/2007 | Carter et al. |
| 2007/0199013 | A1 | 8/2007 | Samari et al. |
| 2007/0274537 | A1 | 11/2007 | Srinivasan |
| 2007/0286451 | A1 | 12/2007 | Rhoads |
| 2007/0300066 | A1 | 12/2007 | Srinivasan |
| 2008/0276265 | A1 | 11/2008 | Topchy et al. |
| 2009/0225994 | A1 | 9/2009 | Topchy et al. |

FOREIGN PATENT DOCUMENTS

| | | | |
|---|---|---|---|
| AU | 747044 | | 9/2000 |
| AU | 2006203639 | | 9/2006 |
| CA | 2041754 | | 2/1991 |
| CA | 2134748 | | 11/1993 |
| CA | 2504552 | | 11/1993 |
| CA | 2628654 | | 11/1993 |
| CA | 2136054 | | 5/1996 |
| CA | 2041754 | | 12/2004 |
| CN | 1461565 | | 12/2003 |
| DE | 69334130 | | 12/2007 |
| DK | 1261155 | | 8/2007 |
| EP | 0245037 | B1 | 11/1987 |
| EP | 0385799 | | 9/1990 |
| EP | 0598682 | | 5/1994 |
| EP | 0748563 | A1 | 12/1996 |
| EP | 0887958 | A1 | 12/1996 |
| EP | 0887958 | A1 | 6/1998 |
| EP | 1261155 | A2 | 11/2002 |
| EP | 0748563 | B1 | 1/2003 |
| EP | 0887958 | B1 | 1/2003 |
| EP | 1261155 | A3 | 9/2003 |
| EP | 1261155 | B1 | 3/2007 |
| ES | 2284777 | | 11/2002 |
| FR | 2559002 | | 8/1995 |
| GB | 2460773 | | 12/2009 |
| JP | 8500471 | | 1/1996 |
| PT | 1261155 | | 7/2007 |
| WO | 8810540 | | 12/1988 |
| WO | 9322875 | | 11/1993 |
| WO | 9411989 | | 5/1994 |
| WO | 9841140 | | 9/1998 |
| WO | 0001699 | | 4/2000 |
| WO | 0019699 | | 4/2000 |
| WO | 0035345 | | 6/2000 |
| WO | 0079709 | | 12/2000 |
| WO | 02065782 | | 8/2002 |
| WO | 03009277 | | 1/2003 |
| WO | 03057605 | | 7/2003 |
| WO | 2006023770 | | 3/2006 |
| WO | WO2006023770 | | 3/2006 |

OTHER PUBLICATIONS

Chinese Patent Office, "Second Office Action", issued in connection with Chinese Patent Application No. 2008800128440, Jan. 11, 2012, (1 pages).
Chinese Patent Office, "First Office Action", issued in connection with Chinese Patent Application No. 200880128616.X, Jan. 4, 2012, (6 pages).
Chinese Patent Office, "First Office action," issued in connection with Chinese Patent Application No. 200880120098.7, Aug. 29, 2011 (9 pages).
Canadian Intellectual Property Office, "Office action", issued in connection with Canadian Patent Application No. 2,717,723, Mar. 28, 2012, (3 pages).
European Patent Office, "Examination Report", issued in connection with European patent application No. 08873178.1, Apr. 24, 2012, (3 pages).
Chinese Patent Office, "Third Office Action", issued in connection with Chinese Patent Application No. 2008800128440, Aug. 1, 2012, (5 pages).
Sukittanon S. et al. "Modulation-scale analysis for content identification", IEEE Transactions on Signal Processing, Oct. 2004, vol. 25, Issue: 10, pp. 3023-3035 (13 pages).
Australian Government, "Notice of Acceptance", issued in connection with Australian patent application No. 2008218716, Apr. 30, 2012, (3 pages).
Crochiere et al. "Real-Time Speech Coding" Apr. 34, 1982, (14 pages).
David John Bull, Curriculum Vitae of David John Bull, shown and sworn on Dec. 23, 2005 (6 pages).
Dr. Khok Khee Pang, Curriculum Vitae of Dr. Khok Khee Pang, shown and sworn on Mar. 27, 2006, (15 pages).
International Bureau, "Written Opinion," issued in connection with International Application No. PCT/US2008/061783, Jan. 29, 2009 (7 pages).
Haitsma et al., Robust Audio Hashing for Content Identification, Philips Research, philips.com, 2001, (8 pages).
Haitsma et al., "A Highly Robust Audio Fingerprinting System", 2002, (9 pages).
John Fredrick Arnold, Curriculum Vitae of John Fredrick Arnold, shown and sworn on Jun. 7, 2006, (39 pages).
International Searching Authority, International Search Report for application No. PCT/US2008/061783, Jan. 29, 2009, (4 pages).
United Kingdom Radio Academy, Techcon Conference, http://www.ibs.org.uk/public/lineuparchive/2003/Aug-Sep/TECHCON_2003.pdf, 2 pages, Jul. 2003.
Wai-Kai Chen, The Circuits and Filters Handbook, p. 137, 149, 157, 163, 721, and 2696. 1995, CRC Press.
International Bureau, "International Preliminary Report on Patentability," issued in connection with International Application No. PCT/US2008/061783, Nov. 3, 2009, (8 pages).
International Searching Authority, "International Search Report" issued in connection with International Application No. PCT/US2008/054434, Feb. 25, 2009, (4 pages).
International Searching Authority, "Written Opinion," issued in connection with International Application No. PCT/US2008/054434, Feb. 25, 2009, (9 pages).
International Searching Authority, "International Search Report," issued in connection with International Application No. PCT/US2008/082657, Apr. 7, 2009, (4 pages).
International Searching Authority, "Written Opinion," issued in connection with International Application No. PCT/US2008/082657, Apr. 7, 2009, (7 pages).
International Bureau, "International Preliminary Report on Patentability," issued in connection with International Application No. PCT/US2008/082657, Sep. 7, 2010 (7 pages).
Australian Patent Office, "Patent Abridgement," issued in connection with Australian Application No. 42260/93, Document No. AU-B-42260193, (144 pages).
European Patent Office, "Supplementary European Search Report," issued in connection with European Application No. 93910943, Oct. 31, 1996, (27 pages).
European Patent Office, "Appeal File History," issued in connection with European Application No. 02076018.7-2223/1261155, Appeal No. T1118/10-3503, on Aug. 13, 2010, (518 pages).
European Patent Office, "Complete File History," issued in connection with European Application No. 02076018.7-2223/1261155, Appeal No. T1118/10-3503, on Aug. 13, 2010, (1732 pages).
European Patent Office, "Opposition File History," issued in connection with European Application No. 02076018.7-2223/1261155, Appeal No. T1118/10-3503, on Mar. 16, 2010, (546 pages).
Markus, Alexander, "Letter Relating to Appeal Procedure," Berne Patent Attorneys, written in connection with European Application No. 02076018.7-2223/1261155, Appeal No. T1118/10-3503, Dec. 17, 2010, (23 pages).
Tucker, Nigel Paul, "Letter Relating to Appeal Procedure," Boult Wade Tennant Patent Attorneys, written in connection with European Application No. 02076018.7-2223/1261155, Appeal No. 11118/10-3503, Dec. 22, 2010, (13 pages).
European Patent Office, "Letter of Patent Proprietor" issued in connection with European Application No. 02076018.7-2223/1261155, Appeal No. T1118/10-3503, written on Dec. 16, 2010, (2 pages).
European Patent Office, "Telecontrol Request for Opposition" issued in connection with European Application No. 02076018.7-2223/1261155, Appeal No. T1118/10-3503, on Dec. 24, 2007, (46 pages).
Lieck, Hans-Peter, "Arbitron Response to Opposition," Boeters & Lieck European Patent and Trademark Attorneys, written in connection with European Application No. 02076018.7-2223/1261155, Appeal No. T11118/10-3503, Nov. 17, 2008, (18 pages).
Storzbach, Michael, "Telecontrol Response," AMMANN Patent Attorneys Limited, Berne, written in connection with European Application No. 02076018.7-2223/1261155, Appeal No. T1118/10-3503, Feb. 18, 2009, (8 pages).
European Patent Office, "Summons to Attend Oral Proceedings" issued in connection with European Application No. 02076018.7-2223/1261155, Appeal No. T1118/10-3503, on Oct. 7, 2009, (4 pages).
Lieck, Hans-Peter, "Arbitron Filing Prior to Oral Proceedings," Boeters & Lieck European Patent and Trademark Attorneys, written in connection with European Application No. 02076018.7-2223/1261155, Appeal No. T1118/10-3503, Dec. 30, 2009, (18 pages).
European Patent Office, "Interlocutory Decision at Opposition," issued in connection with European Application No. 02076018.7-2223/1261155, Appeal No. T1118/10-3503, on Mar. 16, 2010, (14 pages).
Blaser, Stefan, "Telecontrol Submission Listing Further Art," AMMANN Patent Attorneys Limited, Berne, written in connection with European Application No. 02076018.7-2223/1261155, Appeal No. T1118/10-3503, Feb. 18, 2009, (21 pages).
Tucker, Nigel Paul, "Arbitron Appeal," Boult Wade Tennant Patent Attorneys, written in connection with European Application No. 02076018.7-2223/1261155, Appeal No. T1118/10-3503, Jul. 26, 2010, (35 pages).
European Patent Office, "Notice of Deadline for Telecontrol Response" issued in connection with European Application No. 02076018.7-2223/1261155, Appeal No. T1118/10-3503, on Aug. 13, 2010, (4 pages).
International Bureau, International Preliminary Report on Patentability, issued in connection with International Patent Application No. PCT/US2008/054434, issued Aug. 26, 2009, mailed Sep. 3, 2009, (10 pages).
European Patent Office, "Notification of Grant" issued in connection with Great Britain Patent Application Serial No. GB0915239.8, mailed on Sep. 28, 2010, (2 pages).
European Patent Office, Office Communication issued for EP Application No. 08747030.8, dated Jan. 5, 2010, (3 pages).
Intellectual Property Office, GB Examination Report for Application No. GB0915239.8, Sep. 18, 2009, (1 page).
The State Intellectual Property Office of China, Office action issued in connection with Chinese Application No. 2008/80012844.0, issued on Sep. 2, 2010, (12 pages).
Doets, "Theoretical Modeling of a Robust Audio Fingerprinting System," Tech. Rep. Deift Univ. Technol., Deift, The Netherlands, 2004. (4 pages).

METHODS AND APPARATUS FOR CHARACTERIZING MEDIA

RELATED APPLICATIONS

This patent arises from a continuation of U.S. patent application Ser. No. 13/250,663, filed Sep. 30, 2011, which is a continuation of U.S. patent application Ser. No. 12/034,489, filed on Feb. 20, 2008 (now U.S. Pat. No. 8,060,372), which claims priority to U.S. Provisional Patent Application Ser. No. 60/890,680, filed on Feb. 20, 2007, and U.S. Provisional Patent Application Ser. No. 60/894,090, filed on Mar. 9, 2007. The entire contents of the above-identified patent applications are hereby expressly incorporated herein by reference.

FIELD OF THE DISCLOSURE

The present disclosure relates generally to media monitoring and, more particularly, to methods and apparatus for characterizing media and for generating signatures for use in identifying media information.

BACKGROUND

Identifying media information and, more specifically, audio streams (e.g., audio information) using signature matching techniques is known. Known signature matching techniques are often used in television and radio audience metering applications and are implemented using several methods for generating and matching signatures. For example, in television audience metering applications, signatures are generated at monitoring sites (e.g., monitored households) and reference sites. Monitoring sites typically include locations such as, for example, households where the media consumption of audience members is monitored. For example, at a monitoring site, monitored signatures may be generated based on audio streams associated with a selected channel, radio station, etc. The monitored signatures may then be sent to a central data collection facility for analysis. At a reference site, signatures, typically referred to as reference signatures, are generated based on known programs that are provided within a broadcast region. The reference signatures may be stored at the reference site and/or a central data collection facility and compared with monitored signatures generated at monitoring sites. A monitored signature may be found to match with a reference signature and the known program corresponding to the matching reference signature may be identified as the program that was presented at the monitoring site.

DETAILED DESCRIPTION

Figure 1A:
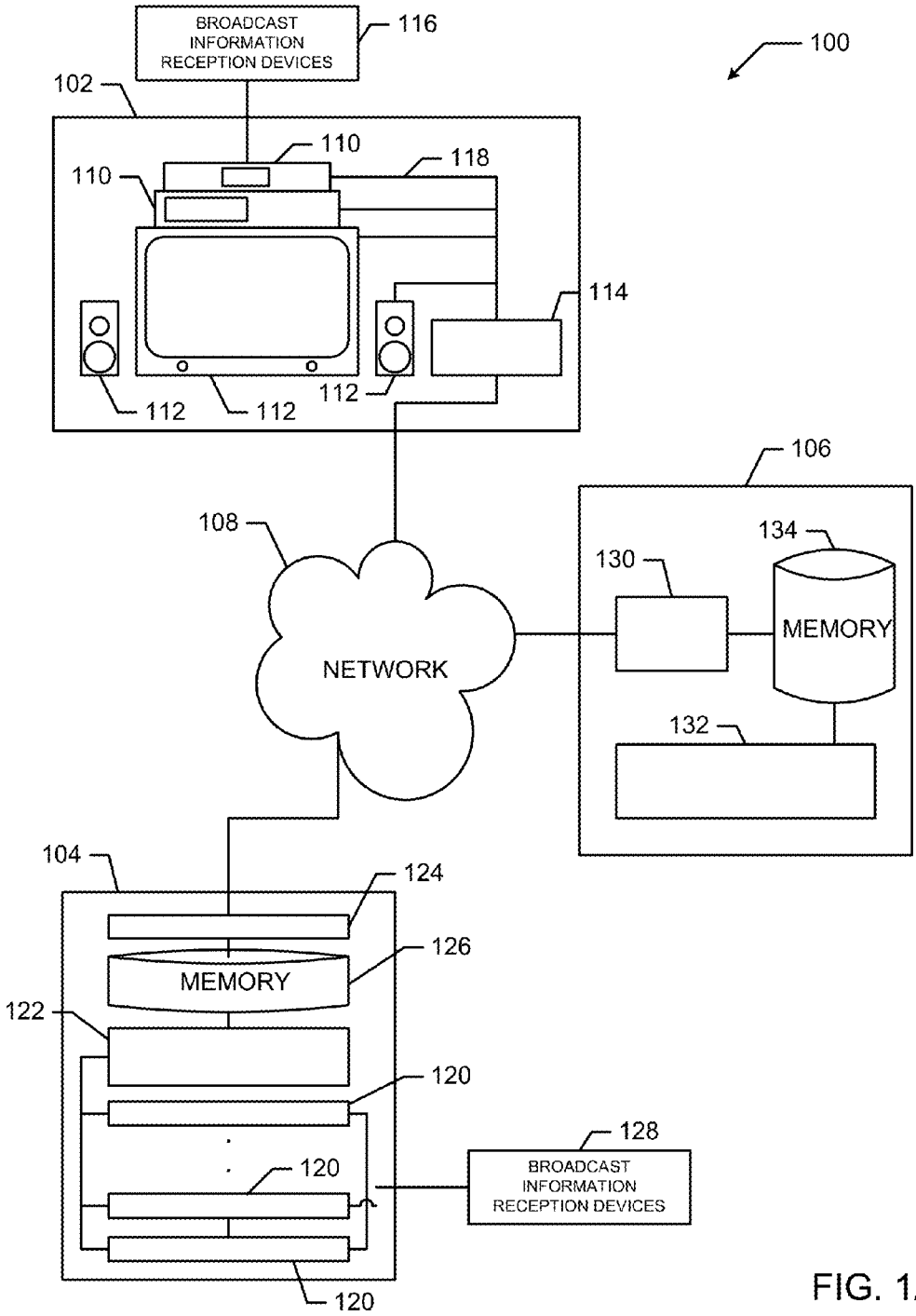
FIGS. 1A and 1B illustrate example audio stream identification systems for generating signatures and identifying audio streams.

Although the following discloses example systems implemented using, among other components, software executed on hardware, it should be noted that such systems are merely illustrative and should not be considered as limiting. For example, it is contemplated that any or all of these hardware and software components could be embodied exclusively in hardware, exclusively in software, or in any combination of hardware and software. Accordingly, while the following describes example systems, persons of ordinary skill in the art will readily appreciate that the examples provided are not the only way to implement such systems.

The methods and apparatus described herein generally relate to generating digital signatures that may be used to identify media information. A digital signature is an audio descriptor that accurately characterizes audio signals for the purpose of matching, indexing, or database retrieval. In particular, the disclosed methods and apparatus are described with respect to generating digital signatures based on audio streams or audio blocks (e.g., audio information). However, the methods and apparatus described herein may also be used to generate digital signatures based on any other type of media information such as, for example, video information, web pages, still images, computer data, etc. Further, the media information may be associated with broadcast information (e.g., television information, radio information, etc.), information reproduced from any storage medium (e.g., compact discs (CD), digital versatile discs (DVD), etc.), or any other information that is associated with an audio stream, a video stream, or any other media information for which the digital signatures are generated. In one particular example, the audio streams are identified based on digital signatures including monitored digital signatures generated at a monitoring site (e.g., a monitored household) and reference digital signatures generated and/or stored at a reference site and/or a central data collection facility.

As described in detail below, the methods and apparatus described herein identify media information including audio streams based on digital signatures. The example techniques described herein compute a signature at a particular time using a block of audio samples by analyzing attributes of the audio spectrum in the block of audio samples. As described below, decision functions, or decision metrics, are computed for signal bands of the audio spectrum and signature bits are assigned to the block of audio samples based on the values of the decision metrics. The decision functions or metrics may be calculated based on comparisons between spectral bands or through the convolution of the bands with two or more vectors. The decision functions may also be derived from other than spectral representations of the original signal, (e.g., from the wavelet transform, the cosine transform, etc.).

Monitored signatures may be generated using the above techniques at a monitoring site based on audio streams associated with media information (e.g., a monitored audio stream) that is consumed by an audience. For example, a monitored signature may be generated based on the audio blocks of a track of a television program presented at a monitoring site. The monitored signature may then be communicated to a central data collection facility for comparison to one or more reference signatures.

Reference signatures are generated at a reference site and/or a central data collection facility using the above techniques on audio streams associated with known media information. The known media information may include media that is broadcast within a region, media that is reproduced within a household, media that is received via the Internet, etc. Each reference signature is stored in a memory with media identification information such as, for example, a song title, a movie title, etc. When a monitored signature is received at the central data collection facility, the monitored signature is compared with one or more reference signatures until a match is found. This match information may then be used to identify the media information (e.g., monitored audio stream) from which the monitored signature was generated. For example, a look-up table or a database may be referenced to retrieve a media title, a program identity, an episode number, etc. that corresponds to the media information from which the monitored signature was generated.

In one example, the rates at which monitored signatures and reference signatures are generated may be different. Of course, in an arrangement in which the data rates of the monitored and reference signatures differ, this difference must be accounted for when comparing monitored signatures with reference signatures. For example, if the monitoring rate is 25% of the reference rate, each consecutive monitored signature will correspond to every fourth reference signature.

Figure 1B:
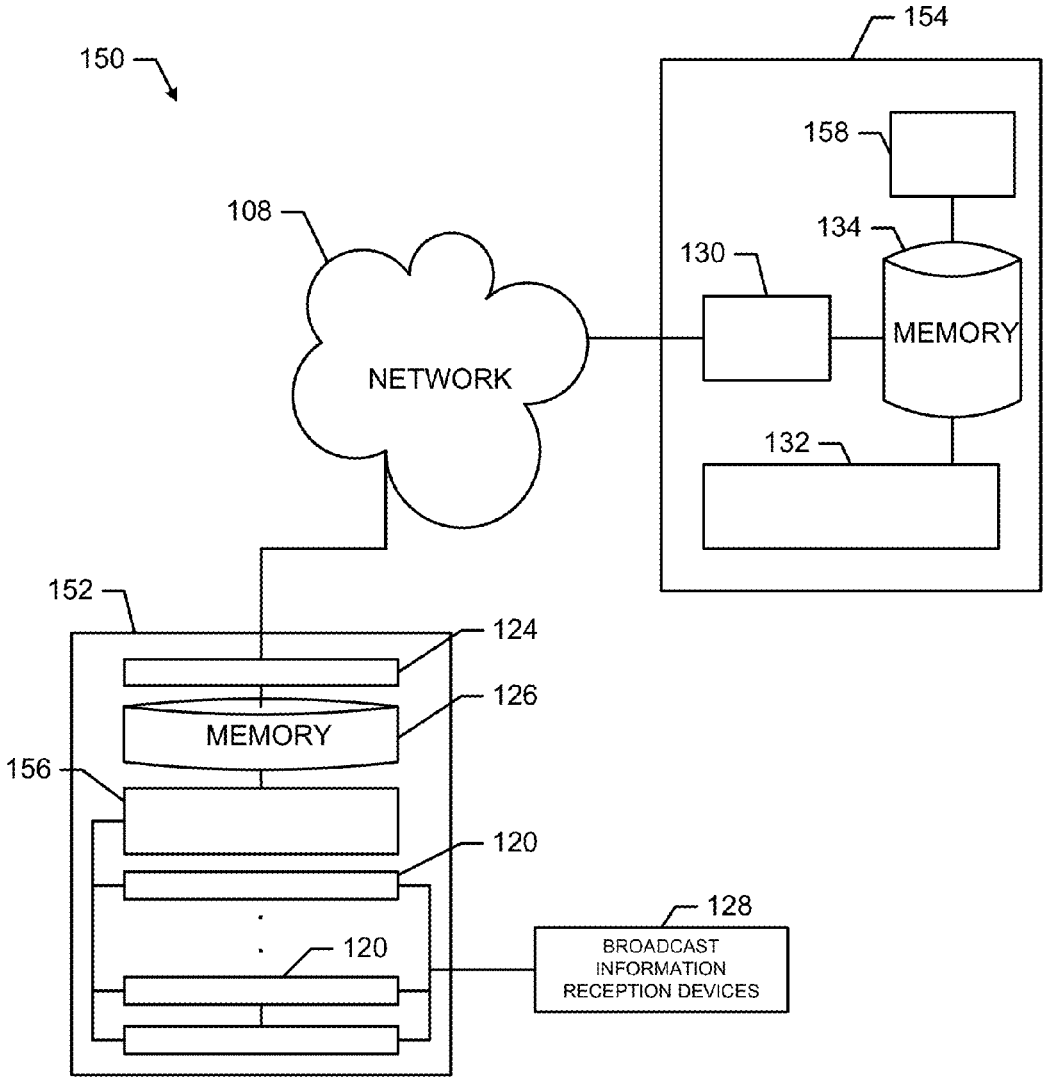

FIGS. 1A and 1B illustrate example audio stream identification systems 100 and 150 for generating digital spectral signatures and identifying audio streams. The example audio stream identification systems 100 and 150 may be implemented as a television broadcast information identification system and a radio broadcast information identification system, respectively. The example audio stream identification system 100 includes a monitoring site 102 (e.g., a monitored household), a reference site 104, and a central data collection facility 106.

Monitoring television broadcast information involves generating monitored signatures at the monitoring site 102 based on the audio data of television broadcast information and communicating the monitored signatures to the central data collection facility 106 via a network 108. Reference signatures may be generated at the reference site 104 and may also be communicated to the central data collection facility 106 via the network 108. The audio content represented by a monitored signature that is generated at the monitoring site 102 may be identified at the central data collection facility 106 by comparing the monitored signature to one or more reference signatures until a match is found. Alternatively, monitored signatures may be communicated from the monitoring site 102 to the reference site 104 and compared one or more reference signatures at the reference site 104. In another example, the reference signatures may be communicated to the monitoring site 102 and compared with the monitored signatures at the monitoring site 102.

The monitoring site 102 may be, for example, a household for which the media consumption of an audience is monitored. In general, the monitoring site 102 may include a plurality of media delivery devices 110, a plurality of media presentation devices 112, and a signature generator 114 that is used to generate monitored signatures associated with media presented at the monitoring site 102.

The plurality of media delivery devices 110 may include, for example, set top box tuners (e.g., cable tuners, satellite tuners, etc.), DVD players, CD players, radios, etc. Some or all of the media delivery devices 110 such as, for example, set top box tuners may be communicatively coupled to one or more broadcast information reception devices 116, which may include a cable, a satellite dish, an antenna, and/or any other suitable device for receiving broadcast information. The media delivery devices 110 may be configured to reproduce media information (e.g., audio information, video information, web pages, still images, etc.) based on, for example, broadcast information and/or stored information. Broadcast information may be obtained from the broadcast information reception devices 116 and stored information may be obtained from any information storage medium (e.g., a DVD, a CD, a tape, etc.). The media delivery devices 110 are communicatively coupled to the media presentation devices 112 and configurable to communicate media information to the media presentation devices 112 for presentation. The media presentation devices 112 may include televisions having a display device and/or a set of speakers by which audience members consume, for example, broadcast television information, music, movies, etc.

The signature generator 114 may be used to generate monitored digital signatures based on audio information, as described in greater detail below. In particular, at the monitoring site 102, the signature generator 114 may be configured to generate monitored signatures based on monitored audio streams that are reproduced by the media delivery devices 110 and/or presented by the media presentation devices 112. The signature generator 114 may be communicatively coupled to the media delivery devices 110 and/or the media presentation devices 112 via an audio monitoring interface 118. In this manner, the signature generator 114 may obtain audio streams associated with media information that is reproduced by the media delivery devices 110 and/or presented by the media presentation devices 112. Additionally or alternatively, the signature generator 114 may be communicatively coupled to microphones (not shown) that are placed in proximity to the media presentation devices 112 to detect audio streams. The signature generator 114 may also be communicatively coupled to the central data collection facility 106 via the network 108.

The network 108 may be used to communicate signatures (e.g., digital spectral signatures), control information, and/or configuration information between the monitoring site 102, the reference site 104, and the central data collection facility 106. Any wired or wireless communication system such as, for example, a broadband cable network, a DSL network, a cellular telephone network, a satellite network, and/or any other communication network may be used to implement the network 108.

As shown in FIG. 1A, the reference site 104 may include a plurality of broadcast information tuners 120, a reference signature generator 122, a transmitter 124, a database or memory 126, and broadcast information reception devices 128. The reference signature generator 122 and the transmitter 124 may be communicatively coupled to the memory 126 to store reference signatures therein and/or to retrieve stored reference signatures therefrom.

The broadcast information tuners 120 may be communicatively coupled to the broadcast information reception devices 128, which may include a cable, an antenna, a satellite dish, and/or any other suitable device for receiving broadcast information. Each of the broadcast information tuners 120 may be configured to tune to a particular broadcast channel. In general, the number of tuners at the reference site 104 is equal to the number of channels available in a particular broadcast region. In this manner, reference signatures may be generated for all of the media information transmitted over all of the channels in a broadcast region. The audio portion of the tuned media information may be communicated from the broadcast information tuners 120 to the reference signature generator 122.

The reference signature generator 122 may be configured to obtain the audio portion of all of the media information that is available in a particular broadcast region. The reference signature generator 122 may then generate a plurality of reference signatures (as described in greater detail below) based on the audio information and store the reference signatures in the memory 126. Although one reference signature generator is shown in FIG. 1, a plurality of reference signature generators may be used in the reference site 104. For example, each of the plurality of signature generators may be communicatively coupled to a respective one of the broadcast information tuners 120.

The transmitter 124 may be communicatively coupled to the memory 126 and configured to retrieve signatures therefrom and communicate the reference signatures to the central data collection facility 106 via the network 108.

The central data collection facility 106 may be configured to compare monitored signatures received from the monitoring site 102 to reference signatures received from the reference site 104. In addition, the central data collection facility 106 may be configured to identify monitored audio streams by matching monitored signatures to reference signatures and using the matching information to retrieve television program identification information (e.g., program title, broadcast time, broadcast channel, etc.) from a database. The central data collection facility 106 includes a receiver 130, a signature analyzer 132, and a memory 134, all of which are communicatively coupled as shown.

The receiver 130 may be configured to receive monitored signatures and reference signatures via the network 108. The receiver 130 is communicatively coupled to the memory 134 and configured to store the monitored signatures and the reference signatures therein.

The signature analyzer 132 may be used to compare reference signatures to monitored signatures. The signature analyzer 132 is communicatively coupled to the memory 134 and configured to retrieve the monitored signatures and the reference signatures from the same. The signature analyzer 132 may be configured to retrieve reference signatures and monitored signatures from the memory 134 and compare the monitored signatures to the reference signatures until a match is found. The memory 134 may be implemented using any machine accessible information storage medium such as, for example, one or more hard drives, one or more optical storage devices, etc.

Although the signature analyzer 132 is located at the central data collection facility 106 in FIG. 1A, the signature analyzer 132 may instead be located at the reference site 104. In such a configuration, the monitored signatures may be communicated from the monitoring site 102 to the reference site 104 via the network 108. Alternatively, the memory 134 may be located at the monitoring site 102 and reference signatures may be added periodically to the memory 134 via the network 108 by transmitter 124. Additionally, although the signature analyzer 132 is shown as a separate device from the signature generators 114 and 122, the signature analyzer 132 may be integral with the reference signature generator 122 and/or the signature generator 114. Still further, although FIG. 1 depicts a single monitoring site (i.e., the monitoring site 102) and a single reference site (i.e., the reference site 104), multiple such sites may be coupled via the network 108 to the central data collection facility 106.

The audio stream identification system 150 of FIG. 1B may be configured to monitor and identify audio streams associated with radio broadcast information. In general, the audio stream identification system 150 is used to monitor the content that is broadcast by a plurality of radio stations in a particular broadcast region. Unlike the audio stream identification system 100 used to monitor television content consumed by an audience, the audio stream identification system 150 may be used to monitor music, songs, etc. that are broadcast within a broadcast region and the number of times that they are broadcast. This type of media tracking may be used to determine royalty payments, proper use of copyrights, etc. associated with each audio composition. The audio stream identification system 150 includes a monitoring site 152, a central data collection facility 154, and the network 108.

The monitoring site 152 is configured to receive all radio broadcast information that is available in a particular broadcast region and generate monitored signatures based on the radio broadcast information. The monitoring site 152 includes the plurality of broadcast information tuners 120, the transmitter 124, the memory 126, and the broadcast information reception devices 128, all of which are described above in connection with FIG. 1A. In addition, the monitoring site 152 includes a signature generator 156. When used in the audio stream identification system 150, the broadcast information reception devices 128 are configured to receive radio broadcast information and the broadcast information tuners 120 are configured to tune to the radio broadcast stations. The number of broadcast information tuners 120 at the monitoring site 152 may be equal to the number of radio broadcasting stations in a particular broadcast region.

The signature generator 156 is configured to receive the tuned to audio information from each of the broadcast information tuners 120 and generate monitored signatures for the same. Although one signature generator is shown (i.e., the signature generator 156), the monitoring site 152 may include multiple signature generators, each of which may be communicatively coupled to one of the broadcast information tuners 120. The signature generator 156 may store the monitored signatures in the memory 126. The transmitter 124 may retrieve the monitored signatures from the memory 126 and communicate them to the central data collection facility 154 via the network 108.

The central data collection facility 154 is configured to receive monitored signatures from the monitoring site 152, generate reference signatures based on reference audio streams, and compare the monitored signatures to the reference signatures. The central data collection facility 154 includes the receiver 130, the signature analyzer 132, and the memory 134, all of which are described in greater detail above in connection with FIG. 1A. In addition, the central data collection facility 154 includes a reference signature generator 158.

The reference signature generator 158 is configured to generate reference signatures based on reference audio streams. The reference audio streams may be stored on any type of machine accessible medium such as, for example, a CD, a DVD, a digital audio tape (DAT), etc. In general, artists and/or record producing companies send their audio works (i.e., music, songs, etc.) to the central data collection facility 154 to be added to a reference library. The reference signature generator 158 may read the audio data from the machine accessible medium and generate a plurality of reference signatures based on each audio work (e.g., the captured audio 300 of FIG. 3). The reference signature generator 158 may then store the reference signatures in the memory 134 for subsequent retrieval by the signature analyzer 132. Identification information (e.g., song title, artist name, track number, etc.) associated with each reference audio stream may be stored in a database and may be indexed based on the reference signatures. In this manner, the central data collection facility 154 includes a database of reference signatures and identification information corresponding to all known and available song titles.

The receiver 130 is configured to receive monitored signatures from the network 108 and store the monitored signatures in the memory 134. The monitored signatures and the reference signatures are retrieved from the memory 134 by the signature analyzer 132 for use in identifying the monitored audio streams broadcast within a broadcast region. The signature analyzer 132 may identify the monitored audio streams by first matching a monitored signature to a reference signature. The match information and/or the matching reference signature are then used to retrieve identification information (e.g., a song title, a song track, an artist, etc.) from a database stored in the memory 134.

Although one monitoring site (e.g., the monitoring site 152) is shown in FIG. 1B, multiple monitoring sites may be communicatively coupled to the network 108 and configured to generate monitored signatures. In particular, each monitoring site may be located in a respective broadcast region and configured to monitor the content of the broadcast stations within a respective broadcast region.

Described below are example signature generation processes and apparatus to create digital signatures of, for example, 24 bits in length. In one example, each signature (i.e., each 24-bit word) is derived from a long block of audio samples having a duration of approximately 2 seconds. Of course, the signature length and the size of the block of audio samples selected are merely examples and other signature lengths and block sizes could be selected.

Figure 2:
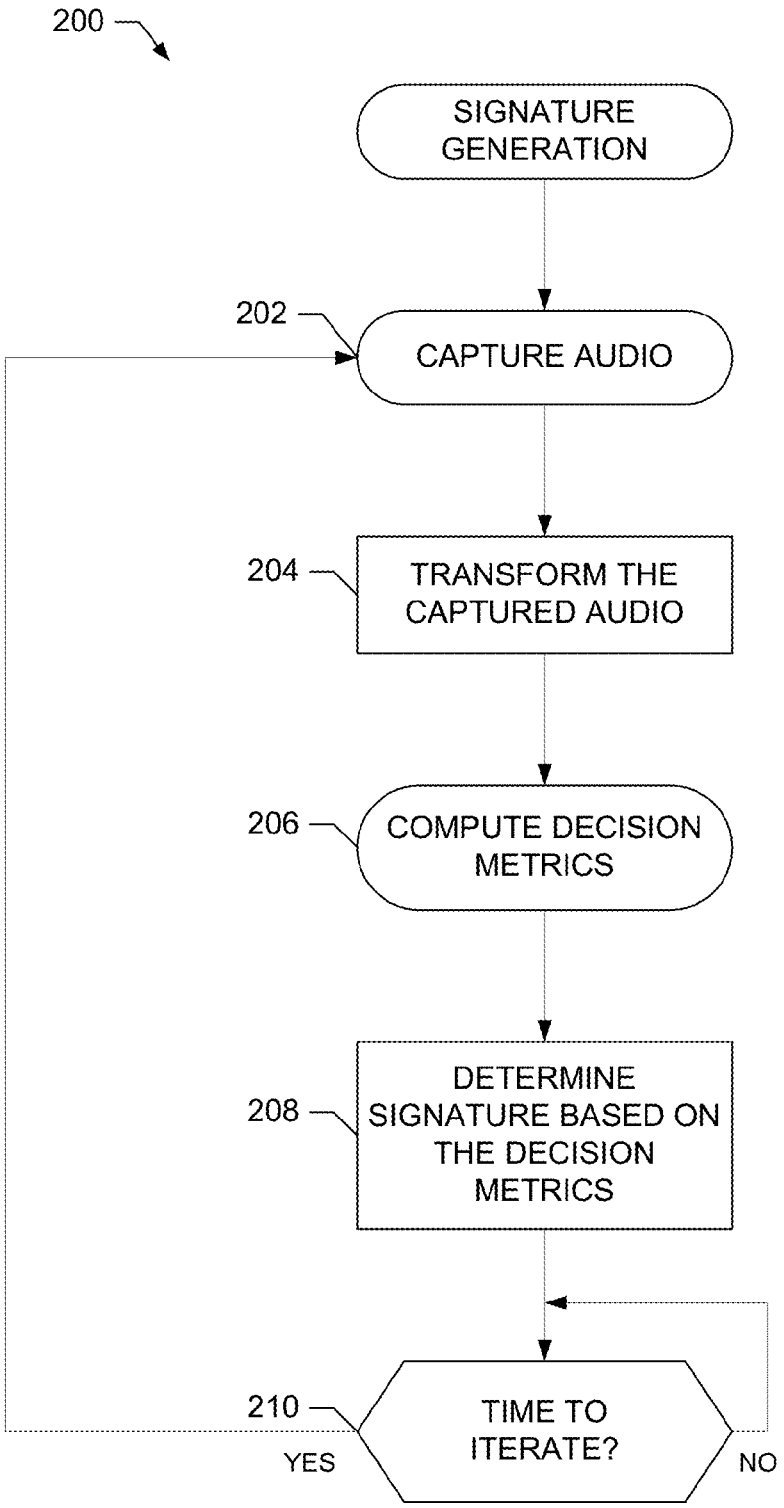
FIG. 2 is a flow diagram illustrating an example signature generation process.

FIG. 2 is a flow diagram representing an example signature generation process 200. As shown in FIG. 2, the signature generation process 200 first captures a block of audio that is to be characterized by a signature (block 202). The audio may be captured from an audio source via, for example, a hardwired connection to an audio source or via a wireless connection, such as an audio sensor, to an audio source. If the audio source is analog, the capturing includes sampling (digitizing) the analog audio source using, for example, an analog-to-digital converter.

An incoming analog audio stream whose signatures are to be determined is digitally sampled at a sampling rate (Fs) of 8 kHz. This means that the analog audio is represented by digital samples thereof that are taken at the rate of eight thousand samples per second, or one sample every 125 microseconds (us). Each of the audio samples may be represented by 16 bits of resolution. Generically, herein the number of captured samples in an audio block is referred to with the variable N. In one example, the audio is sampled at 8 kHz for a time duration of 2.048 seconds, which results in N=16384 time domain samples. In such an arrangement the time range of audio captured corresponds to t . . . t+N/Fs, wherein t is the time of the first sample. Of course, the specific sampling rate, bit resolutions, sampling duration, and number of resulting time domain samples specified above is merely one example.

Figure 3:
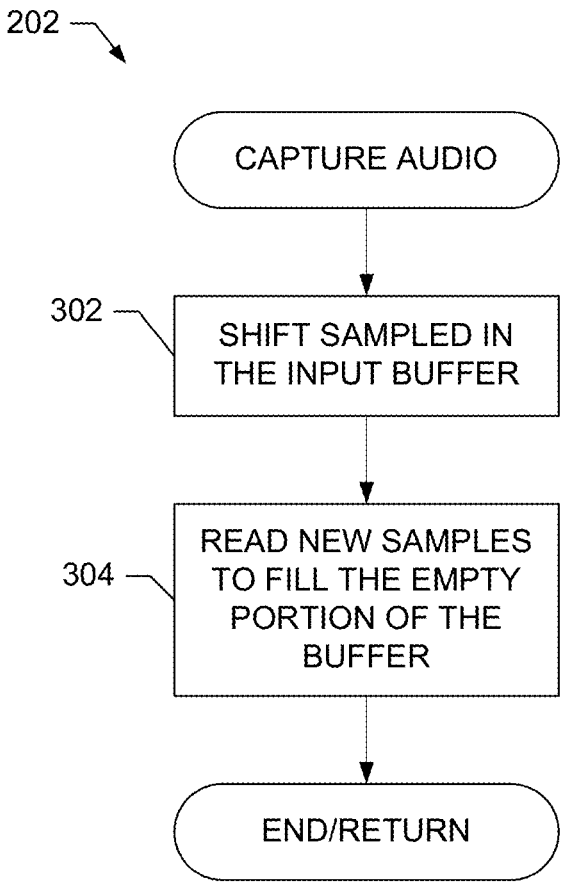
FIG. 3 is a flow diagram illustrating further detail of an example capture audio process shown in FIG. 2.

As shown in FIG. 3, the capture audio process 202 may be implemented by shifting samples in an input buffer by an amount, such as 256 samples (block 302) and reading new samples to fill the emptied portion of the buffer (block 304). As described in the example below, signatures that characterize the block of audio are derived from frequency bands comprised of multiple frequency bins rather than frequency bins because individual bins are more sensitive to the selection of the audio block. In some examples, it is important to ensure that the signature is stable with respect to block alignment because reference and metered site signatures, hereinafter referred to as site unit signatures, are computed from blocks of audio samples that are unlikely to be aligned with one another in the time domain. To address this issue, in one example, reference signatures are captured at intervals of 32 milliseconds (i.e., the 16384 sample audio block is updated by appending 256 new samples and discarding the oldest 256 samples). In an example site unit, signatures are captured at intervals of 128 milliseconds or sample increments of 1024 samples. Thus, the worst cast block misalignment between reference and site units is therefore 128 samples. A desirable feature of the signature is robustness to shifts of 128 samples. In fact, during the match process described below it is expected that the site unit signature is identical to a reference signature in order to obtain a successful "hit" into a look up table.

Returning to FIG. 2, after the audio is captured (block 202), the captured audio is transformed (blocks 204). In one example, the transformation may be a transformation from the time domain into the frequency domain. For example, the N samples of captured audio may be converted into an audio spectrum that is represented by N/2 complex discrete Fourier transformation (DFT) coefficients including real and imaginary frequency components. Equation 1, below, shows one example frequency transformation equation that may be performed on the time domain amplitude values to convert the same into complex-valued frequency domain spectral coefficients X[k].

$$X[k] = \sum_{n=0}^{n=N-1} x[n]e^{-\frac{2\pi nk}{N}} \qquad \text{Equation 1}$$

Wherein X[k] is a complex number having real and imaginary components, such that $X[k]=X_R[k]+jX_I[k]$, $0 \leqq k \leqq N-1$ with real and imaginary parts $X_R[k]$, $X_I[k]$, respectively. Each frequency component is identified by a frequency bin index k. Although, the above description refers to DFT processing, any suitable transformation, such as wavelet transforms, discrete cosine transform (DCT), MDCT, Haar transforms, Walsh transforms, etc., may be used.

After the transformation is complete (block 204), the process 200 computes decision metrics (block 206). As described below, the decision metrics may be calculated by dividing the transformed audio into bands (i.e., into several bands, each of which includes several complex-valued frequency component bins). In one example, the transformed audio may be divided into 24 bands of bins. After the division, a decision metric is determined for each band, for example, based on the relationship between values of the spectral coefficients in the bands as compared to one another or to another band, or as convolved with two or more vectors. The relationships may be based on the processing of groups of frequency components within each band. In one particular example, groups of frequency components may be selected in an iterative manner such that all frequency component bins within a band are, at some point in the iteration, a member of a group. The decision metric calculations yield, for example, one decision metric for each band of bins that are considered. Thus, for 24 bands of bins, 24 discrete decision metrics are generated. Example decision metric computations are described below in conjunction with FIGS. 4-6.

Based on the decision metrics (block 206), the process 200 determines a digital signature (block 208). One example construct for a signature, therefore, is to derive each bit from the sign (i.e., the positive or negative nature) of a corresponding decision metric. For example, each bit of a 24-bit signature is set to 1 if the corresponding decision metric (which is defined below to be $D_B[p]$, where p is the band including the collection of bins under analysis) is non-negative. Conversely, a bit of a 24-bit signature is set to 0 if the corresponding decision metric ($D_B[p]$) is negative.

After the signature has been determined (block 208), the process 200 determines if it is time to iterate the signature generation process (block 210). When it is time to generate another signature, the process 200 captures audio (block 202) and the process 200 repeats.

Figure 4:
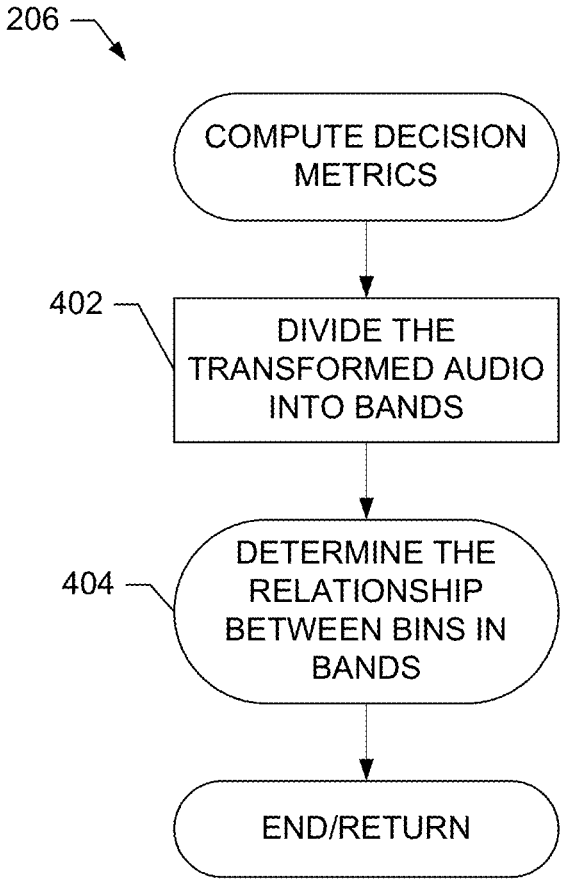
FIG. 4 is a flow diagram illustrating further detail of an example compute decision metric process shown in FIG. 2.

An example process of computing decision metrics 206 is shown in FIG. 4. According to this example, after the audio is transformed (block 206), the transformed audio is divided into bands (block 402). In one example, a 24-bit signature S(t) at instant of time t (e.g., the time at which the last amplitude was captured) is computed by observing the spectral components (real and imaginary) at, for example, 3072 consecutive bins starting at k=508, which are divided into 24 bands. The 3072 frequency bins span a frequency range extending, for example, from approximately 250 Hz to approximately 3.25 kHz. This frequency range is the frequency range in which most of the audio energy is contained in typical audio content such as speech and music. Sets of these bins form, for example, 24 frequency bands B[p], $0 \leqq p \leqq P$, where P=24 bands, each including 128 bins. In general, in some examples, the number of bins within a band may not be the same across different bands.

Figure 5:
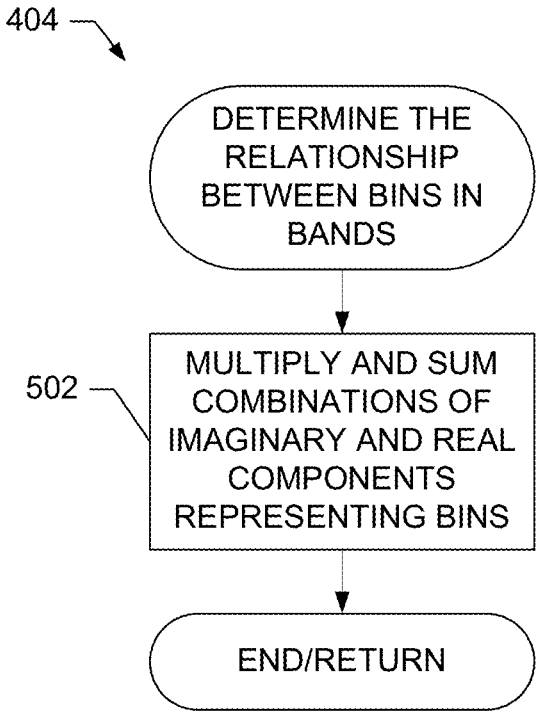
FIG. 5 is a flow diagram illustrating further detail of an example process to determine the relationship between bins and band shown in FIG. 4.
Figure 6:
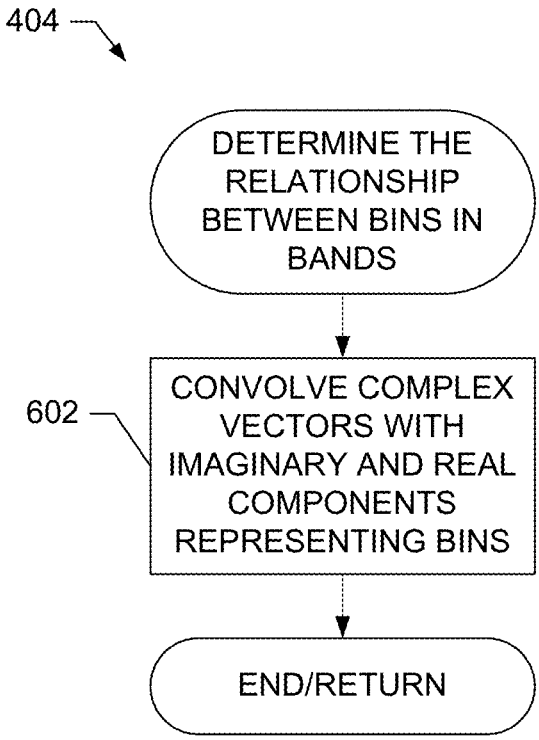
FIG. 6 is a flow diagram illustrating further detail of a second example process to determine the relationship between bins and band shown in FIG. 4

After the division of the transformed audio into bands (block 402), relationships are determined between the bins in each band (block 402). That is, to characterize the spectrum using a signature, a relationship between neighboring bins in a band has to be computed in a form that can be reduced to a single data bit for each band. These relationships may be determined by grouping frequency component bins and performing operations on each group. Two example manners of determining the relationship between bins in each band are shown in FIGS. 5 and 6. In some examples, the decision function computation for a selected band can be viewed as a data reduction step, whereby the values of the spectral coefficients in a band are reduced to a one-bit value.

In general, it is possible to construct the decision function or metric D without referring to the energies of the underlying bands or magnitudes of the spectral components. In order to derive a different function D, it is possible to construct a quadratic form with respect to the vectors of real and imaginary components of the DFT coefficients can be used. Consider a set of vectors {XR(k), XI(k)}, where k is an index of DFT coefficient. The quadratic form D can be written as linear combination of the pairwise scalar (dot) products of the vectors in the above set. The relationship between bins and in each band may be determined through multiplication and summing of imaginary and real components representing the bins. This is possible because, as noted above, the results of a transformation include real and imaginary components for each bin. An example decision metric is shown below in Equation 2. As shown below, D[m] is a product of real and imaginary spectral components of a neighborhood or group of bins m−w, . . . m, . . . m+w surrounding a bin with frequency index m. Of course, the calculation of D[m] is iterated for each value of m within the band. Thus, the calculation shown in Equation 2 is iterated until an entire band of frequency component bins has been processed.

$$D[m] = \sum_{m-w \le j,k,r,s,u,v \le m+w} [\alpha_{jk} X_R[j] X_I[k] + \beta_{rs} X_R[r] X_R[s] + \gamma_{uv} X_I[u] X_I[v]] \quad \text{Equation 2}$$

Where $\alpha_{jk}$, $\beta_{rs}$, $\gamma_{uv}$ are coefficients to be determined and j, k, r, s, u, v are indexes spanning across the neighborhood (i.e., across all the bins in the band). The design goal is to determine the numerical values of the coefficients $\{\alpha, \beta, \gamma\}$ in this quadratic form that completely specifies D[m].

After the D[m] values have been calculated for each value of m in a selected band based on bins neighboring each value of m, the D[m] are summed across all bins constituting a band p to obtain an overall decision metric $D_B[P]$ for band p. In general, $D_B[p]$ can be represented by linear combinations of dot products of the vectors formed by real and imaginary parts of the spectral amplitudes. Hence, the decision function, for a band p can also be represented in the form shown in Equation 3. As noted above in conjunction with FIG. 2, in one example, the sign (i.e., the positive or negative nature of the decision metric) determines the signature bit assignment for the band under consideration.

$$D_B[p] = \sum_{p_S \le j,k,r,s,u,v \le p_E} [\lambda_{jk} X_R[j] X_I[k] + \mu_{rs} X_R[r] X_R[s] + \eta_{uv} X_I[u] X_I[v]] \quad \text{Equation 3}$$

Turning now to FIG. 6, the relationship between the bins in the bands may be determined in a different example manner than that described above in conjunction with FIG. 5. As described below, this second example manner is a method of deriving a robust signature from a frequency spectrum of a signal, such as an audio signal, is by convolving each bin representing or constituting a band of the frequency spectrum with a pair of M-component complex vectors.

In one such example, the decision metric may limit a group width to 3 bins. That is, the division carried out by block 402 of FIG. 4 results in groups having three bins each, such that a value of w=1 can be considered. In such an arrangement, rather than computing the coefficients $\alpha_{jk}$, $\beta_{rs}$, $\gamma_{uv}$, in one example a pair of 3-element complex vectors may be used to perform a convolution with three selected frequency bins (e.g., the three Fourier coefficients) constituting a group (block 602). Example vectors that may be used in the convolution are shown below as Equations 4 and 5, below. As with the above description, the consideration of 3 bin wide groups may be indexed and incremented until each bin of the band has been considered.

While specific example vectors are shown in the following equations, it should be noted that any suitable values of vectors may be used to perform a frequency domain convolution or sliding correlation with the groups of three frequency bins of interest (i.e., the Fourier coefficients representing the bins of interest). In other examples, vectors having longer lengths than three may be used. Thus, the following example vectors are merely one implementation of vectors that may be used. In one example, the pair of vectors used to generate signature bits that are either 1 or 0 with equal probability must have constant energy (i.e., the sum of squares of the elements of both the vectors must be identical). In addition, in instances in which it is desirable to maintain computational simplicity, the number of vector elements should be small. In one example implementation, the number of elements is odd in order to create a neighborhood that is symmetrical in length on either side of a frequency bin of interest. While generating signatures it may be advantageous to choose different vector pairs for different bands in order to obtain maximum de-correlation between the bits of a signature.

$$W_1:\left[-\frac{1}{2}\left(\frac{1}{2}-j\right),\ 1,\ -\frac{1}{2}\left(\frac{1}{2}+j\right)\right] \quad \text{Equation 4}$$

$$W_2:\left[-\frac{1}{2}\left(\frac{1}{2}+j\right),\ 1,\ -\frac{1}{2}\left(\frac{1}{2}-j\right)\right] \quad \text{Equation 5}$$

For a bin with index k the convolution with a complex 3-element vector W: [a+jb,c,d+je] results in the complex output shown in Equation 6.

$$A_W[k]=(X_R[k]+jX_I[k])c+(X_R[k-1]+jX_I[k-1])(a+jb)+(X_R[k+1]+jX_I[k+1])(d+je) \quad \text{Equation 6}$$

For the above vector pair, the difference in energy can be computed between the convolved bin amplitudes using the two vectors. This difference is shown in Equation 7.

$$D_{W1W2}[k]=|A_{W1}[k]|^2-|A_{W2}[k]|^2 \quad \text{Equation 7}$$

Upon expansion and simplification, the results are as shown in Equation 8.

$$D_{W1W2}[k]=2(X_R[k]Q_k-X_I[k]P_k)+X_R[k-1]X_I[k+1]-X_R[k+1]X_I[k-1] \quad \text{Equation 8}$$

Where $P_k=X_R[k-1]-X_R[k+1]$ and $Q_k=X_I[k-1]-X_I[k+1]$.

The foregoing computes a feature related to the nature of the energy distribution for bin k within the block of time domain samples. In this instance it is a symmetry measure. If the energy difference is summed across all the bins of a band $B_P$, a corresponding distribution measure for the entire block is obtained as shown in Equation 9.

$$D_B[p]=\sum_{k=p_s}^{p_e} D_{W1W2}[k] \quad \text{Equation 9}$$

Where $p_s$ and $p_e$ are the start and end bin indexes for the band p. Hence an overall decision function for a band of interest can be a sum of the products of real and imaginary components with appropriately chosen numeric coefficients for individual bins contributing to this band.

For a signature to be unique, each bit of the signature should be highly de-correlated from other bits. Such decorrelation can be achieved by using different coefficients in the convolutional computation across different bands. Convolution by vectors containing symmetric complex triplets helps to improve such a de-correlation. In the above example, correlation products are obtained that include both real and imaginary parts of all the 3 bins associated with a convolution. This is significantly different from simple energy measures based on squaring and adding the real and imaginary parts.

In some arrangement, one of the drawbacks is that about 30% of the signatures generated contain adjacent bits that are highly correlated. For example, the most significant 8 bits of the 24-bit signature could all be either 1's or 0's. Such signatures are referred to as trivial signatures because they are derived from blocks of audio in which the distribution of energy, at least with regard to a significant portion of the spectrum nearly identical for many spectral bands. The highly correlated nature of the resulting frequency bands leads to signature bits that are identical to one another across large segments. Several audio waveforms that differ greatly from one another can produce such signatures that would result in false positive matches. Such trivial signatures may be rejected during the matching process and may be detected by the matching process by the presence of long strings of 1's or 0's.

In order to extract meaningful signatures from such skewed distributions it may be necessary to use more than two vectors to extract band representations. In one example, three vectors may be used. Examples of three vectors that may be used are shown below at Equations 10-12.

$$W_1:\left[-\frac{1}{2},\ 1,\ -\frac{1}{2}\right] \quad \text{Equation 10}$$

$$W_2:\left[\frac{1}{2}\left(\frac{1}{2}-\frac{\sqrt{3}}{2}j\right),\ 1,\ \frac{1}{2}\left(\frac{1}{2}+\frac{\sqrt{3}}{2}j\right)\right] \quad \text{Equation 11}$$

$$W_3:\left[\frac{1}{2}\left(\frac{1}{2}+\frac{\sqrt{3}}{2}j\right),\ 1,\ \frac{1}{2}\left(\frac{1}{2}-\frac{\sqrt{3}}{2}j\right)\right] \quad \text{Equation 12}$$

The 24-bit signatures may now be computed in such a manner that each bit p, $0 \leqq p \leqq 23$ of the signature differs from its neighbor in the vector pair used for determining its value:

$$D_B[p]=\sum_{k=p_s}^{p_e} D_{W_mW_n}[k] \quad \text{Equation 12}$$

As an example, bits or bands p=0, 3, 6, etc. may use m=1, n=2 in the above equation, whereas bits or bands p=1, 4, 7, etc. may use m=1, n=3 and bits or bands p=2, 5, 8, etc. may use m=2, n=3. That is, the indices may be combined with any subset of the vectors. Even though adjacent bits are derived from frequency bands close to one another, the use of a different vector pair for the convolution makes them respond to different sections of the audio block. In this way they become de-correlated.

Of course, more than three vectors may be used and the vectors may be combined with bits having indices in any suitable manner. In some examples, the use of more than two vectors may result in a reduction in the occurrence of trivial signatures has been reduced to 10%. Additionally, some examples using more than two vectors may result in a 20% increase in the number of successful matches.

The foregoing has described signaturing techniques that may be carried out to determine signatures representative of a portion of captured audio. As explained above, the signatures may be generated as reference signatures or site unit signatures. In general, reference signatures may be computed at intervals of, for example, 32 milliseconds or 256 audio samples and stored in a "hash table." In one example, the table look-up address is the signature itself. The content of the location is an index specifying the location in the reference audio stream from where the specific signature was captured. When a site unit signature is received for matching its value constitutes the address for entry into the hash table. If the location contains a valid time index it shows that a potential match has been detected. However, in one example, a single match based on signatures derived from a 2 second block of audio cannot be used to declare a successful match.

In fact the hash table accessed by the site unit signature itself may contain multiple indexes stored as a linked list. Each such entry indicates a potential match location in the reference audio stream. In order to confirm a match, subsequent site unit signatures are examined for "hits" in the hash table. Each such hit may generate indexes pointing to different reference audio stream locations. Site unit signatures are also time indexed.

The difference in index values between site unit signatures and matching reference unit signatures, provides an offset value. When a successful match is observed several site unit signatures separated from one another in time steps of 128 milliseconds yield hits in the hash table such that the offset value is the same as a previous hit. When the number of identical offsets observed in a segment of site unit signatures exceeds a threshold we can confirm a match between 2 corresponding time segments in the reference and site unit streams.

Figure 7:
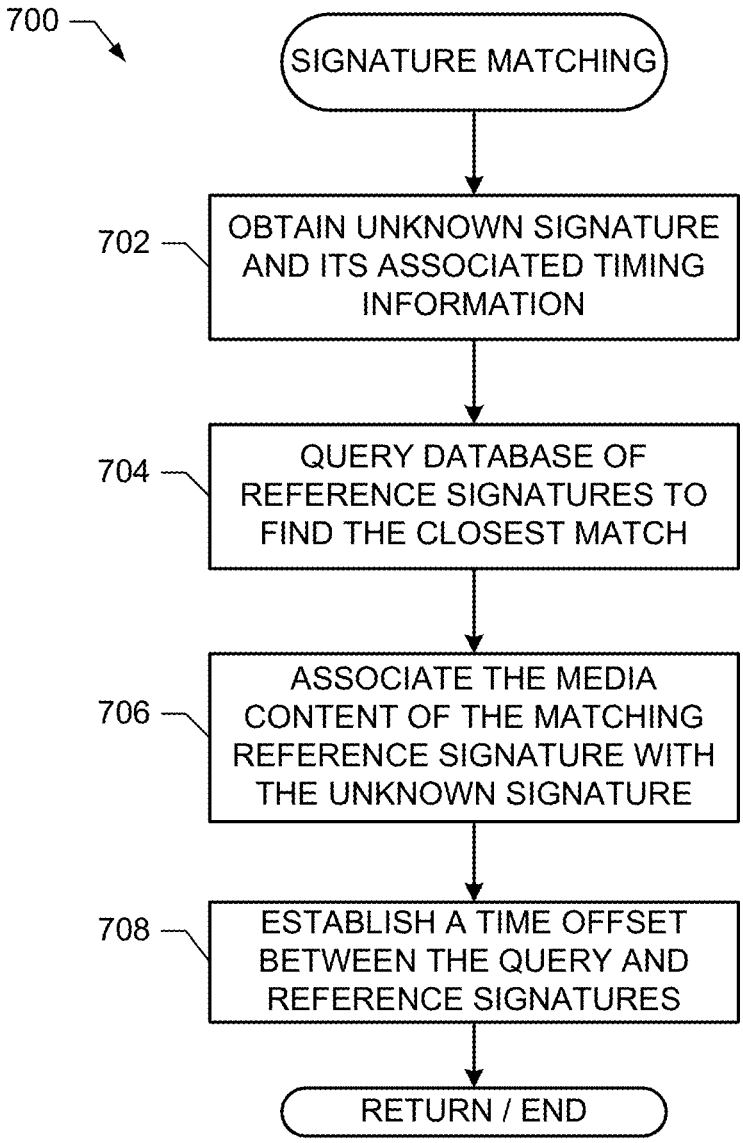
FIG. 7 is a flow diagram of an example signature matching process.

FIG. 7 shows one example signature matching process 700 that may be carried out to compare reference signatures (i.e., signatures determined at a reference site(s)) to monitored signatures (i.e., signatures determined at a monitoring site). The ultimate goal of signature matching is to find the closest match between a query audio signature (e.g., monitored audio) and signatures in a database (e.g., signatures taken based on reference audio). The comparison may be carried out at a reference site, a monitoring site, or any other data processing site having access to the monitored signatures and a database containing reference signatures.

Figure 8:
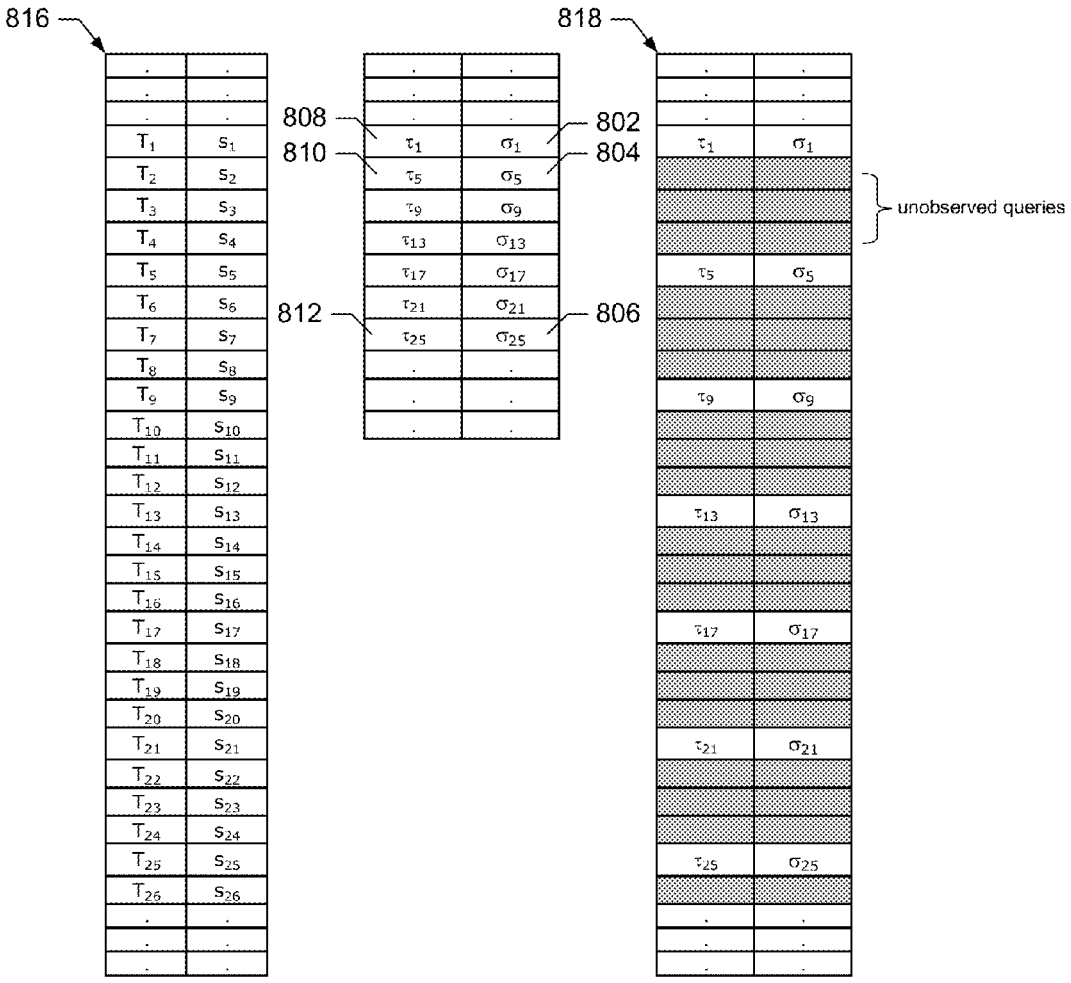
FIG. 8 is a diagram showing how signatures may be compared in accordance with the flow diagram of FIG. 7.

Now turning in detail to the example method of FIG. 7, the example process 700 involves obtaining a monitored signature and its associated timing (block 702). As shown in FIG. 8, a signature collection may include a number of monitored signatures, three of which are shown in FIG. 8 at reference numerals 802, 804 and 806. Each of the signatures is represented by a sigma (σ). Each of the monitored signatures 802, 804, 806 may include timing information 808, 810, 812, whether that timing information is implicit or explicit.

A query is then made to a database containing reference signatures (block 704) to identify the signature in the database having the closest match. In one implementation, the measure of similarity (closeness) between signatures is taken to be a Hamming distance, namely, the number of position at which the values of query and reference bit strings differ. In FIG. 8, a database of signatures and timing information is shown at reference numeral 816. Of course, the database 806 may include any number of different signatures from different media presentations. An association is then made between the program associated with the matching reference signature and the unknown signature (block 706).

Optionally, the process 700 may then establish an offset between the monitored signature and the reference signature (block 708). This offset is helpful because it remains constant for a significant period of time for consecutive query signatures whose values are obtained from the continuous content. The constant offset value in itself is a measure indicative of matching accuracy. This information may be used to assist the process 700 in further database queries.

In instances where all of the descriptors of more than one reference signature are associated with a Hamming distance below the predetermined Hamming distance threshold, more than one monitored signature may need to be matched with respective reference signatures of the possible matching reference audio streams. It will be relatively unlikely that all of the monitored signatures generated based on the monitored audio stream will match all of the reference signatures of more than one reference audio stream, and, thus erroneously matching more than one reference audio stream to the monitored audio stream can be prevented.

The example methods, processes, and/or techniques described above may be implemented by hardware, software, and/or any combination thereof. More specifically, the example methods may be executed in hardware defined by the block diagrams of FIGS. 9 and 10. The example methods, processes, and/or techniques may also be implemented by software executed on a processor system such as, for example, the processor system 1110 of FIG. 11.

Figure 9:
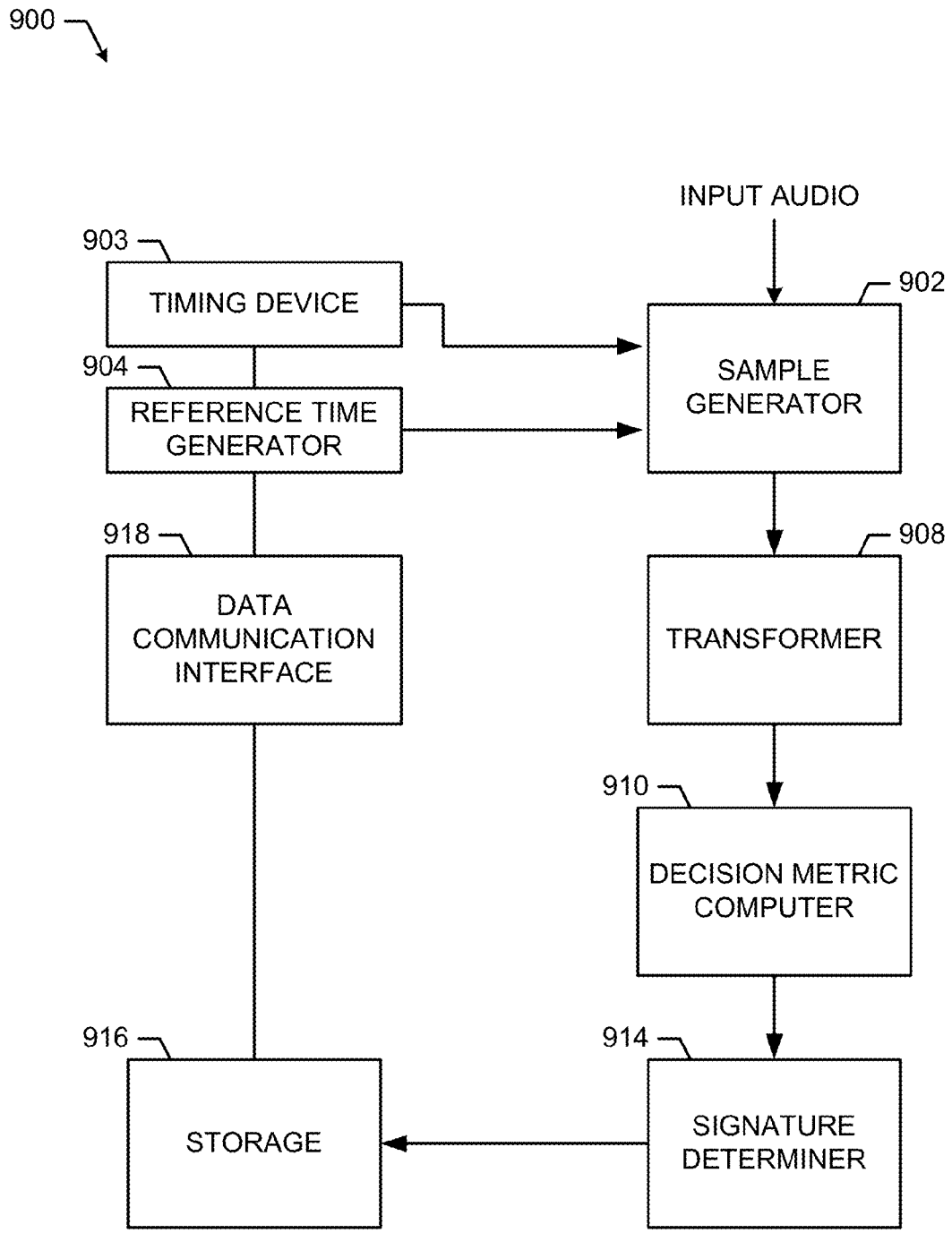
FIG. 9 is a block diagram of an example signature generation system for generating signatures based on audio streams or audio blocks.

FIG. 9 is a block diagram of an example signature generation system 900 for generating digital spectral signatures. In particular, the example signature generation system 900 may be used to generate monitored signatures and/or reference signatures based on the sampling, transforming, and decision metric computation, as described above. For example, the example signature generation system 900 may be used to implement the signature generators 114 and 122 of FIG. 1A or the signature generators 156 and 158 of FIG. 1B. Additionally, the example signature generation system 900 may be used to implement the example methods of FIGS. 2-6.

As shown in FIG. 9, the example signature generation system 900 includes a sample generator 902, a transformer 908, a decision metric computer 910, a signature determiner 914, storage 916, and a data communication interface 918, all of which may be communicatively coupled as shown. The example signature generation system 900 may be configured to obtain an example audio stream, acquire a plurality of audio samples from the example audio stream to form a block of audio and from that single block of audio, generate a signature representative thereof.

The sample generator 902 may be configured to obtain the example audio or media stream. The stream may be any analog or digital audio stream. If the example audio stream is an analog audio stream, the sample generator 902 may be implemented using an analog-to-digital converter. If the example audio stream is a digital audio stream, the sample generator 902 may be implemented using a digital signal processor. Additionally, the sample generator 902 may be configured to acquire and/or extract audio samples at any desired sampling frequency Fs. For example, as described above, the sample generator may be configured to acquire N samples at 8 kHz and may use 16 bits to represent each sample. In such an arrangement, N may be any number of samples such as, for example, 16384. The sample generator 902 may also notify the reference time generator 904 when an audio sample acquisition process begins. The sample generator 902 communicates samples to the transformer 908.

The timing device 903 may be configured to generate time data and/or timestamp information and may be implemented by a clock, a timer, a counter, and/or any other suitable device. The timing device 903 may be communicatively coupled to the reference time generator 904 and may be configured to communicate time data and/or timestamps to the reference time generator 904. The timing device 903 may also be communicatively coupled to the sample generator 902 and may assert a start signal or interrupt to instruct the sample generator 902 to begin collecting or acquiring audio sample data. In one example, the timing device 903 may be implemented by a real-time clock having a 24-hour period that tracks time at a resolution of milliseconds. In this case, the timing device 903 may be configured to reset to zero at midnight and track time in milliseconds with respect to midnight.

The reference time generator 904 may initialize a reference time $t_0$ when a notification is received from the sample generator 902. The reference time $t_0$ may be used to indicate the time within an audio stream at which a signature is generated. In particular, the reference time generator 904 may be configured to read time data and/or a timestamp value from the timing device 903 when notified of the beginning of a sample acquisition process by the sample generator 902. The reference time generator 904 may then store the timestamp value as the reference time $t_0$.

The transformer 908 may be configured to perform an N/2 point DFT on each of 16384 sample audio blocks. For example, if the sample generator obtains 16384 samples, the transformer will produce a spectrum from the samples wherein the spectrum is represented by 8192 discrete frequency coefficients having real and imaginary components.

In one example, the decision metric computer 910 is configured to identify several frequency bands (e.g., 24 bands) within the DFTs generated by the transformer 908 by grouping adjacent bins for consideration. In one example, three bins are selected per band and 24 bands are formed. The bands may be selected according to any technique. Of course, any number of suitable bands and bins per band may be selected.

The decision metric computer 910 then determines a decision metric for each band. For example, decision metric computer 910 may multiply and add the complex amplitudes or energies in adjacent bins of a band. Alternatively, as described above, the decision metric computer 910 may convolve the bins with two or more vectors of any suitable dimensionality. For example, as the decision metric computer 910 may convolve three bins of a band with two vectors, each of which has three dimensions. In a further example, the decision metric computer 910 may convolve three bins of a band with two vectors selected from a set of three vectors, wherein two of three vectors are selected based on the band being considered. For example, the vectors may be selected in a rotating fashion, wherein the first and second vectors are used for a first band, the first and third vectors are used for a second band, and the second and third vectors are used for a third band, and wherein such a selection rotation cycles.

The results of the decision metric computer 910 is a single number for each band of bins. For example, if there are 24 bands of bins, 24 decision metrics will be produced by the decision metric computer 910.

The signature determiner 914 operates on the resulting values from the decision metric computer 910 to produce one signature bit for each of the decision metrics. For example, if the decision metric is positive, it may be assigned a bit value of one, whereas a negative decision metric may be assigned a bit value of zero. The signature bits are output to the storage 916.

The storage may be any suitable medium for accommodating signature storage. For example, the storage 916 may be a memory such as random access memory (RAM), flash memory, or the like. Additionally or alternatively, the storage 916 may be a mass memory such as a hard drive, an optical storage medium, a tape drive, or the like.

The storage 916 is coupled to the data communication interface 918. For example, if the system 900 is in a monitoring site (e.g., in a person's home) the signature information in the storage 916 may be communicated to a collection facility, a reference site, or the like, using the data communication interface 918.

Figure 10:
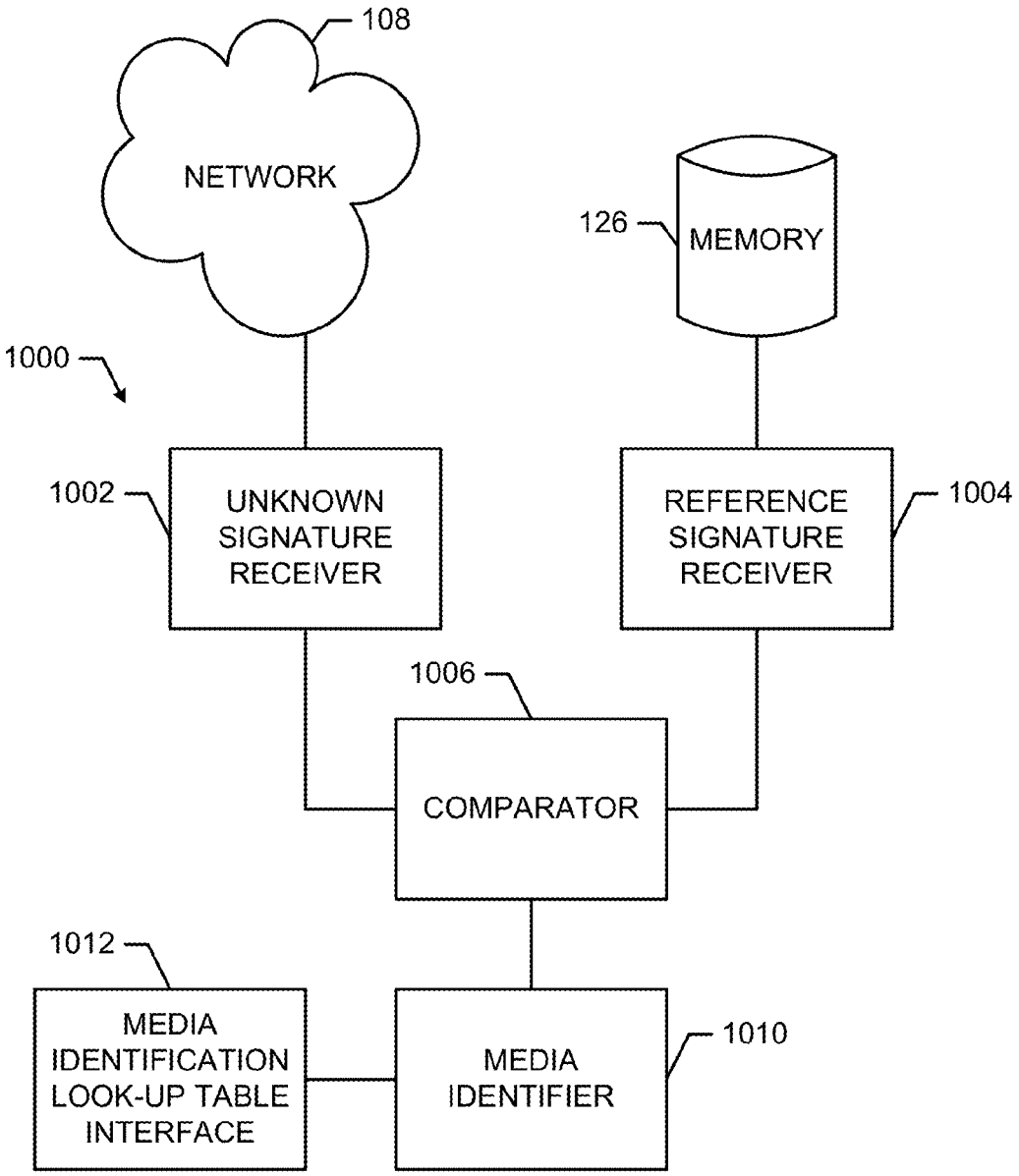
FIG. 10 is a block diagram of an example signature comparison system for comparing signatures.

FIG. 10 is a block diagram of an example signature comparison system 1000 for comparing digital spectral signatures. In particular, the example signature comparison system 1000 may be used to compare monitored signatures with reference signatures. For example, the example signature comparison system 1000 may be used to implement the signature analyzer 132 of FIG. 1A to compare monitored signatures with reference signatures. Additionally, the example signature comparison system 1600 may be used to implement the example process of FIG. 7.

The example signature comparison system 1000 includes a monitored signature receiver 1002, a reference signature receiver 1004, a comparator 1006, a Hamming distance filter 1008, a media identifier 1010, and a media identification look-up table interface 1012, all of which may be communicatively coupled as shown.

The monitored signature receiver 1002 may be configured to obtain monitored signatures via the network 108 (FIG. 1) and communicate the monitored signatures to the comparator 1606. The reference signature receiver 1604 may be configured to obtain reference signatures from the memory 134 (FIGS. 1A and 1B) and communicate the reference signatures to the comparator 1006.

The comparator 1006 and the Hamming distance filter 1008 may be configured to compare reference signatures to monitored signatures using Hamming distances. In particular, the comparator 1006 may be configured to compare descriptors of monitored signatures with descriptors from a plurality of reference signatures and to generate Hamming distance values for each comparison. The Hamming distance filter 1008 may then obtain the Hamming distance values from the comparator 1006 and filter out non-matching reference signatures based on the Hamming distance values.

Figure 11:
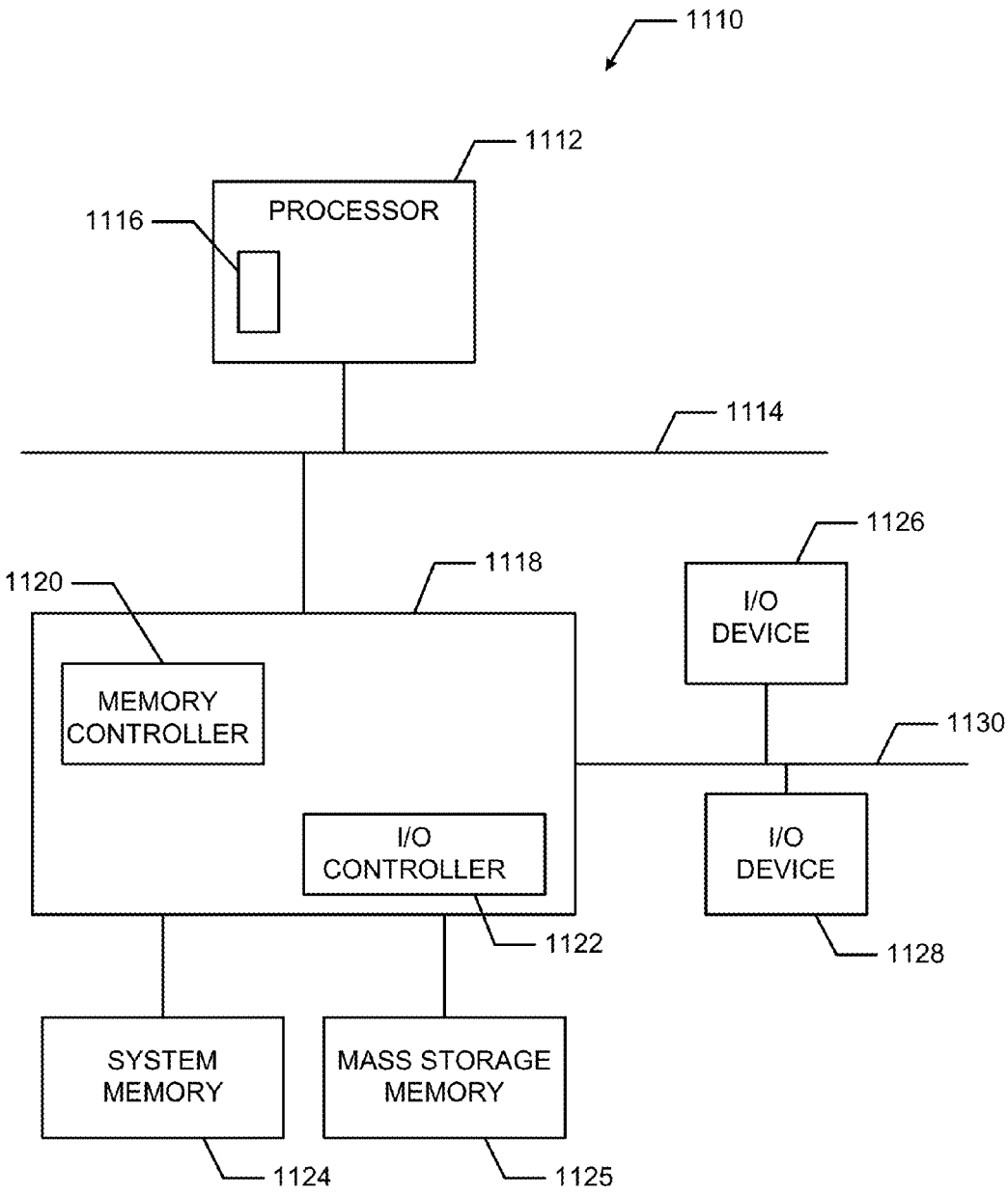
FIG. 11 is a block diagram of an example processor system that may be used to implement the methods and apparatus described herein.

After a matching reference signature is found, the media identifier 1010 may obtain the matching reference signature and in cooperation with the media identification look-up table interface 1012 may identify the media information associated with an unidentified audio stream. For example, the media identification look-up table interface 1012 may be communicatively coupled to a media identification look-up table or a database that is used to cross-reference media identification information (e.g., movie title, show title, song title, artist name, episode number, etc.) based on reference signatures. In this manner, the media identifier 1010 may retrieve media identification information from the media identification database based on the matching reference signatures. FIG. 11 is a block diagram of an example processor system 1110 that may be used to implement the apparatus and methods described herein. As shown in FIG. 11, the processor system 1110 includes a processor 1112 that is coupled to an interconnection bus or network 1114. The processor 1112 includes a register set or register space 116, which is depicted in FIG. 11 as being entirely on-chip, but which could alternatively be located entirely or partially off-chip and directly coupled to the processor 1112 via dedicated electrical connections and/or via the interconnection network or bus 1114. The processor 1112 may be any suitable processor, processing unit or microprocessor. Although not shown in FIG. 11, the system 1110 may be a multi-processor system and, thus, may include one or more additional processors that are identical or similar to the processor 1112 and that are communicatively coupled to the interconnection bus or network 1114.

The processor 1112 of FIG. 11 is coupled to a chipset 1118, which includes a memory controller 1120 and an input/output (I/O) controller 1122. As is well known, a chipset typically provides I/O and memory management functions as well as a plurality of general purpose and/or special purpose registers, timers, etc. that are accessible or used by one or more processors coupled to the chipset. The memory controller 1120 performs functions that enable the processor 1112 (or processors if there are multiple processors) to access a system memory 1124 and a mass storage memory 1125.

The system memory 1124 may include any desired type of volatile and/or non-volatile memory such as, for example, static random access memory (SRAM), dynamic random access memory (DRAM), flash memory, read-only memory (ROM), etc. The mass storage memory 1125 may include any desired type of mass storage device including hard disk drives, optical drives, tape storage devices, etc.

The I/O controller 1122 performs functions that enable the processor 1112 to communicate with peripheral input/output (I/O) devices 1126 and 1128 via an I/O bus 1130. The I/O devices 1126 and 1128 may be any desired type of I/O device such as, for example, a keyboard, a video display or monitor, a mouse, etc. While the memory controller 1120 and the I/O controller 1122 are depicted in FIG. 11 as separate functional blocks within the chipset 1118, the functions performed by these blocks may be integrated within a single semiconductor circuit or may be implemented using two or more separate integrated circuits.

The methods described herein may be implemented using instructions stored on a computer readable medium that are executed by the processor 1112. The computer readable medium may include any desired combination of solid state, magnetic and/or optical media implemented using any desired combination of mass storage devices (e.g., disk drive), removable storage devices (e.g., floppy disks, memory cards or sticks, etc.) and/or integrated memory devices (e.g., random access memory, flash memory, etc.).

As will be readily appreciated, the foregoing signature generation and matching processes and/or methods may be implemented in any number of different ways. For example, the processes may be implemented using, among other components, software, or firmware executed on hardware. However, this is merely one example and it is contemplated that any form of logic may be used to implement the processes. Logic may include, for example, implementations that are made exclusively in dedicated hardware (e.g., circuits, transistors, logic gates, hard-coded processors, programmable array logic (PAL), application-specific integrated circuits (ASICs), etc.) exclusively in software, exclusively in firmware, or some combination of hardware, firmware, and/or software. For example, instructions representing some portions or all of processes shown may be stored in one or more memories or other machine readable media, such as hard drives or the like. Such instructions may be hard coded or may be alterable. Additionally, some portions of the process may be carried out manually. Furthermore, while each of the processes described herein is shown in a particular order, those having ordinary skill in the art will readily recognize that such an ordering is merely one example and numerous other orders exist. Accordingly, while the foregoing describes example processes, persons of ordinary skill in the art will readily appreciate that the examples are not the only way to implement such processes.

Although certain methods, apparatus, and articles of manufacture have been described herein, the scope of coverage of this patent is not limited thereto.

What is claimed is:

1. An apparatus, comprising:

a transformer to convert at least a portion of a block of audio into a frequency domain representation including a plurality of frequency components;

a decision metric processor to:

define a band of the frequency components;

determine a difference in energy between a first convolution of a first complex vector with a first group of frequency bins in the band and a second convolution of a second complex vector with a second group of frequency bins in the band; and determine a decision metric for the band based on the difference;

a signature determiner to determine a signature based on a value of the decision metric; and a processor to implement at least one of the transformer, the decision metric processor, or the signature determiner.

2. An apparatus as defined in claim 1, wherein the first group of frequency bins comprises 3 frequency bins.

3. An apparatus as defined in claim 1, wherein the decision metric processor is to:

define a second band of the frequency components;

compute a second difference in energy between a third convolution of a third complex vector with a third group of frequency bins in the second band and a fourth convolution of a fourth complex vector with a fourth group of frequency bins, the third complex vector being different than the first complex vector and the fourth complex vector being different than the second complex vector; and determine the decision metric for the band based on the first and second differences.

4. An apparatus as defined in claim 1, wherein the first convolution comprises a convolution between a complex vector and respective Fourier coefficients of the frequency bins in the first group.

5. An apparatus as defined in claim 1, wherein the first and second complex vectors have constant energy.

6. An apparatus as defined in claim 1, wherein the first complex vector has the form $$[a+jb,c,d+je],$$

where a, b, c, d, and e are constants.

7. An apparatus as defined in claim 1, wherein the decision metric processor is to determine the difference in energy using the following equation:

$$D_{W1W2}[k]=|A_{W1}[k]|^2-|A_{W2}[k]|^2,$$

where W1 is the first complex vector, W2 is the second complex vector, $A_{W1}$ is a result of the first convolution, $A_{W2}$ is a result of the second convolution, k is a frequency bin index, and $D_{W1W2}[k]$ is a difference function for the index k, the first complex vector W1, and the second complex vector W2.

8. A method, comprising:

converting a portion of a block of audio into a frequency domain representation including a plurality of frequency components;

defining a band of the frequency components;

using a processor, determining a difference in energy between a first convolution of a first complex vector with a first group of frequency bins in the band and a second convolution of a second complex vector with a second group of frequency bins in the band;

using the processor, determining a decision metric for the band based on the difference; and determining a signature based on a value of the decision metric.

9. A method as defined in claim 8, wherein the first group of frequency bins comprises 3 frequency bins.

10. A method as defined in claim 8, further comprising:

defining a second band of the frequency components;

computing a second difference in energy between a third convolution of a third complex vector with a third group of frequency bins in the second band and a fourth convolution of a fourth complex vector with a fourth group of frequency bins, the third complex vector being different than the first complex vector and the fourth complex vector being different than the second complex vector; and determining the decision metric for the band based on the first and second differences.

11. A method as defined in claim 8, wherein the first convolution comprises a convolution between a complex vector and respective Fourier coefficients of the frequency bins in the first group.

12. A method as defined in claim 8, wherein the first and second complex vectors have constant energy.

13. A method as defined in claim 8, wherein the first complex vector has the form $$[a+jb,c,d+je],$$

where a, b, c, d, and e are constants.

14. A method as defined in claim 8, wherein determining the difference in energy comprises using the following equation:

$$D_{W1W2}[k]=|A_{W1}[k]|^2-|A_{W2}[k]|^2,$$

where W1 is the first complex vector, W2 is the second complex vector, $A_{W1}$ is a result of the first convolution, $A_{W2}$ is a result of the second convolution, k is a frequency bin index, and $D_{W1W2}[k]$ is a difference function for the index k, the first complex vector W1, and the second complex vector W2.

15. A tangible computer readable storage medium comprising computer readable instructions which, when executed, cause a processor to:

convert a portion of a block of audio into a frequency domain representation including a plurality of frequency components;

define a band of the frequency components;

determine a difference in energy between a first convolution of a first complex vector with a first group of frequency bins in the band and a second convolution of a second complex vector with a second group of frequency bins in the band;

determine a decision metric for the band based on the difference; and determine a signature based on a value of the decision metric.

16. A storage medium as defined in claim 15, wherein the instructions further cause the processor to:

define a second band of the frequency components;

compute a second difference in energy between a third convolution of a third complex vector with a third group of frequency bins in the second band and a fourth convolution of a fourth complex vector with a fourth group of frequency bins, the third complex vector being different than the first complex vector and the fourth complex vector being different than the second complex vector; and determine the decision metric for the band based on the first and second differences.

17. A storage medium as defined in claim 15, wherein the first convolution comprises a convolution between a complex vector and respective Fourier coefficients of the frequency bins in the first group.

18. A storage medium as defined in claim 15, wherein the first and second complex vectors have constant energy.

19. A storage medium as defined in claim 15, wherein the first complex vector has the form $$[a+jb,c,d+je],$$

where a, b, c, d, and e are constants.

20. A storage medium as defined in claim 15, wherein determining the difference in energy comprises using the following equation:

$$D_{W1W2}[k]=|A_{W1}[k]|^2-|A_{W2}[k]|^2,$$

where W1 is the first complex vector, W2 is the second complex vector, $A_{W1}$ is a result of the first convolution, $A_{W2}$ is a result of the second convolution, k is a frequency bin index, and $D_{W1W2}[k]$ is a difference function for the index k, the first complex vector W1, and the second complex vector W2.

* * * * *